US008182312B2

(12) United States Patent
Truer et al.

(10) Patent No.: US 8,182,312 B2
(45) Date of Patent: May 22, 2012

(54) CMP SYSTEM WITH WIRELESS ENDPOINT DETECTION SYSTEM

(75) Inventors: Randolph E. Truer, San Luis Obispo, CA (US); Michael Starman, San Luis Obispo, CA (US)

(73) Assignee: Strasbaugh, San Luis Obispo, CA (US)

( * ) Notice: Subject to any disclaimer, the term of this patent is extended or adjusted under 35 U.S.C. 154(b) by 855 days.

(21) Appl. No.: 12/205,861

(22) Filed: Sep. 6, 2008

(65) Prior Publication Data

US 2010/0062685 A1 Mar. 11, 2010

(51) Int. Cl.
*B24B 49/00* (2012.01)

(52) U.S. Cl. ..... 451/8; 451/56

(58) Field of Classification Search ..... 451/5, 8, 451/41, 56

See application file for complete search history.

(56) References Cited

U.S. PATENT DOCUMENTS 6,447,369 B1 9/2002 Moore
6,739,945 B2 * 5/2004 Halley et al. ..... 451/6
6,884,150 B2 4/2005 Barbour
6,911,662 B2 6/2005 Kim et al.
6,916,225 B2 7/2005 Sugiyama et al.
6,976,901 B1 12/2005 Halley et al.
7,163,435 B2 1/2007 Lim et al.
7,235,154 B2 6/2007 Dalrymple
7,537,511 B2 * 5/2009 Kistler ..... 451/5
2001/0024929 A1 9/2001 Moore
2002/0090887 A1 * 7/2002 Halley et al. ..... 451/6
2003/0216107 A1 11/2003 Barbour
2004/0235392 A1 11/2004 Ohta
2005/0105103 A1 5/2005 Schietinger et al.
2005/0150599 A1 7/2005 Dalrymple et al.
2006/0116051 A1 6/2006 Halley et al.
2006/0148383 A1 7/2006 Lehman et al.
2007/0082582 A1 4/2007 Gwo et al.
2007/0235133 A1 * 10/2007 Benassi ..... 156/345.12
2008/0004743 A1 * 1/2008 Goers et al. ..... 700/121

* cited by examiner

*Primary Examiner* — Maurina Rachuba
(74) *Attorney, Agent, or Firm* — K. David Crockett, Esq.; Crockett & Crockett, PC

(57) ABSTRACT

A CMP polishing pad with an optical sensor assembly embedded in the pad, connected to a transceiver and/or power supply mounted at the center of the pad or at the outer edge of the pad which communicates wirelessly with a control system.

3 Claims, 3 Drawing Sheets

6
15
7
1
16
6
4
5
4
5
10
8
9
3
13
13
14
12
14
2
11
18
10p

CMP SYSTEM WITH WIRELESS ENDPOINT DETECTION SYSTEM

FIELD OF THE INVENTIONS

The inventions described below relate to the field of polishing pads for use in chemical mechanical polishing.

BACKGROUND OF THE INVENTIONS

In our prior U.S. Patents, Halley, Polishing Pad With Built-In Optical Sensor, U.S. Pat. No. 6,986,701 (Jan. 17, 2006) and Wolf, Polishing Pad With Built-In Optical Sensor, U.S. Pat. No. 6,485,354 (Nov. 26, 2002), we described polishing pads with built-in optical sensor assemblies for use in chemical mechanical planarization processes. The sensors assemblies included light sources and light detectors which are used to detect changes in the surface of an integrated circuit or in the thickness of films built on the wafer during polishing so that technicians involved in polishing wafers know exactly when to stop polishing. The sensor assemblies and optical sensors are embedded within the thickness of the polishing pad, and thus eliminate the need for drilling holes into the platen, as we had previously proposed in Truer, Optical View Port For Chemical Mechanical Planarization Endpoint Detection, U.S. Pat. No. 6,146,242 (Nov. 14, 2000). The incorporation of the optical sensor into the pad also eliminated the need for drilling holes through the platen as suggested in Birang, Forming A Transparent Window In A Polishing Pad For A Chemical Mechanical Polishing Apparatus, U.S. Pat. No. 5,893,796 (Apr. 13, 1999). In Birang's system, an optical sensor was placed under the platen, which required that a hole be drilled in completely through the platen, and also permitted sensing only when the hole in the plated passed over the sensor. The wafers to be polished are composite structures that include strata of different materials. Typically, the outermost stratum is polished away until its interface with an underlying stratum has been reached. At that point it is said that the end point of the polishing operation has been reached. The optical emitter/detector embedded in the pad is able to detect transitions from an oxide layer to a silicon layer as well as transitions from a metal to an oxide, or other material. The optical sensor can also be used to measure the thickness of a layer in processes intended to planarize a layer while leaving a uniformly thick film on the wafer. When a system controller (any suitable computer and appropriate interfaces to the emitter/detector) determines that the polishing process has reached a desired endpoint (complete removal of a metal layer, or reduction of a layer to a desired thickness), the system controller provides output to an operator indicating that the process endpoint has been reached, or operates the associated polishing system to cease polishing. The real-time data derived from the optical sensor enables the end-point detection without the need to disengage the wafer from the polishing equipment and interrupt the polishing process. This greatly increases the efficiency of the polishing process.

SUMMARY

The devices and methods described below provide for a polishing pad with an embedded sensor assembly wherein the necessary cables for communication between the sensor assembly and any necessary transceiver are provided in the form of ribbon cables with a thickness corresponding to the thickness of the adhesive layer which holds the polishing pad to the platen.

In our prior patents, we have disclosed various coupling means for transmitting optical information from the sensor embedded in the pad, including a centrally located hub which was wired to the sensor and wireless communication system in which the all the power and communications circuitry resided in a small disk or puck-like assembly embedded in the pad. As described below, the transfer of data can be facilitated by placing a wireless transceiver on the edge of the pad and platen. In this position, a larger power supply and/or transmitter can be provided for the transceiver, without disrupting the balance of the platen, so that numerous polishing operations may be accomplished using a battery-operated transceiver.

DETAILED DESCRIPTION OF THE INVENTIONS

Figure 1:
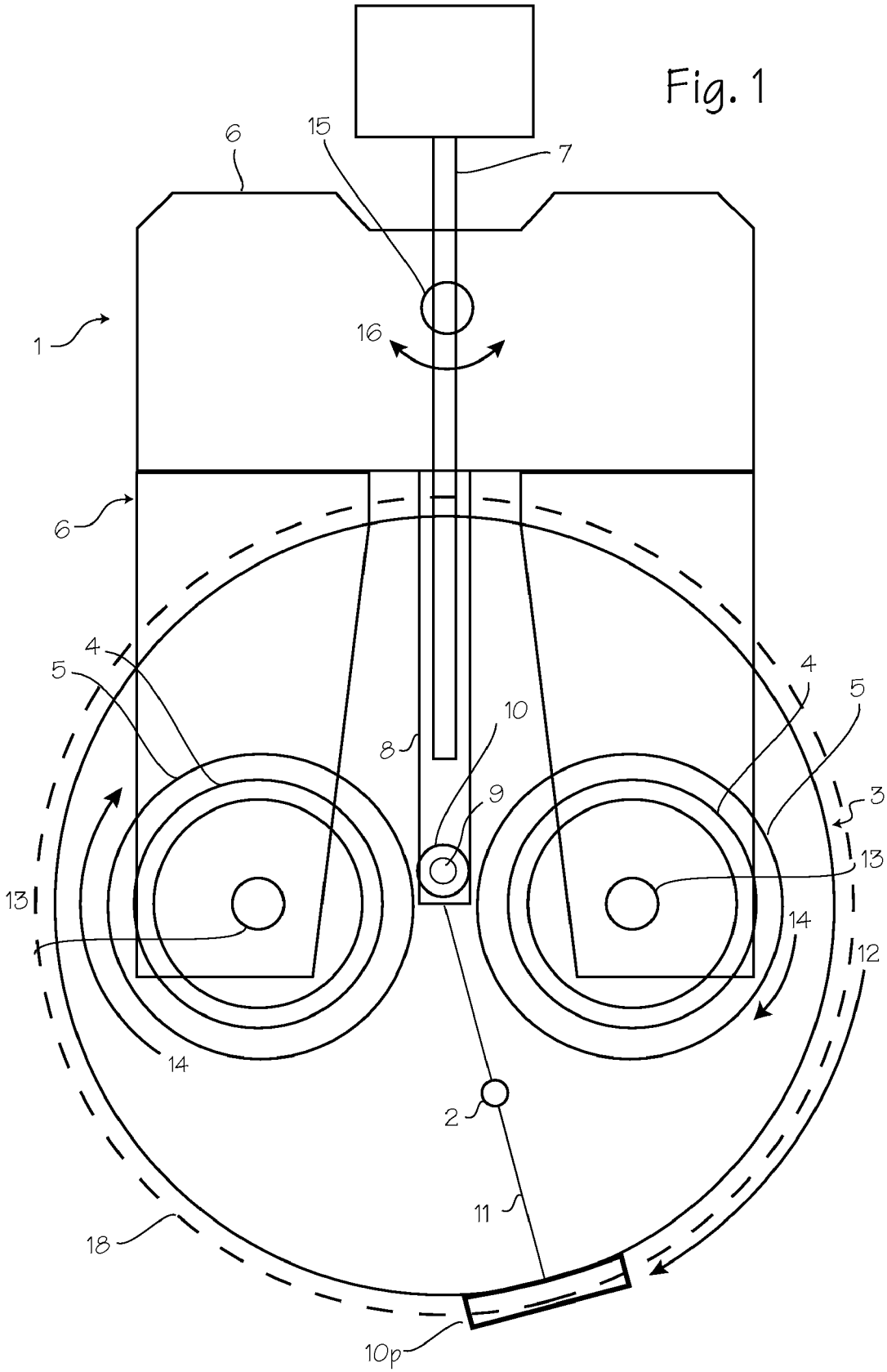
FIG. 1 shows a top view of a chemical mechanical planarization machine for polishing wafers using a polishing pad embedded with optical sensors and a transceiver mounted on the edge of the platen.

FIG. 1 is an overhead view of a chemical mechanical system 1 with the optical port 2 cut into the polishing pad 3. The wafer 4 (or other work piece requiring planarization or polishing) is held by the polishing head 5 and suspended over the polishing pad 3 from a translation arm 6. Other systems may use several polishing heads that hold several wafers, and separate translation arms on opposite sides (left and right) of the polishing pad. The slurry used in the polishing process is injected onto the surface of the polishing pad through slurry injection tube 7.

A transceiver and power assembly is provided to provide power to an emitter/detector assembly disposed within the optical port 2. The transceiver and power assembly may be centrally located in the suspension arm or peripherally located on the edge of the polishing platen 17. If centrally located, the transceiver and power assembly may be provided on the suspension arm 8 which holds a non-rotating hub 9 suspended over a rotating hub 10 (which includes means for communicating signals to the transceiver and power assembly as described in our U.S. Pat. No. 6,485,354) or within the rotating hub itself. The hub 10 is fixed relative to the rotating pad, and is attached to an electrical conducting assembly located within the pad where the hub attaches, to transmit power to the optical assembly and receive signals from the optical sensors it the optical assembly. If the transceiver and power assembly is peripherally located, it is fixed on the outer edge of the platen, either on top of the platen, under the platen, or on the outer side of the platen, as illustrated by the placement of transceiver and power assembly 10*p*. The electrical conducting assembly can an electrically conducting ribbon, also known as a flex circuit or ribbon cable, marked as item 11. The ribbon 11 electrically connects an optical sensing mechanism, located within the optical port 2 and embedded in the pad 3, to the electronics in the electronics hub 10. The transceiver may be battery operated, and may communicate with the control system wirelessly, especially where the transceiver is placed off-center on the platen of polishing pad, as is the transceiver and power assembly 10*p*.

The window rotates with the polishing pad, which itself rotates on a process drive table, or platen 17, in the direction of arrow 12. The polishing heads rotate about their respective spindles 13 usually in the direction of arrows 14. The polishing heads themselves are translated back and forth over the surface of the polishing pad by the translating spindle 15, as indicated by arrow 16. Thus, the optical window 2 passes under the polishing heads while the polishing heads are both rotating and translating, swiping a complex path across the wafer surface on each rotation of the polishing pad/platen assembly.

Figure 2:
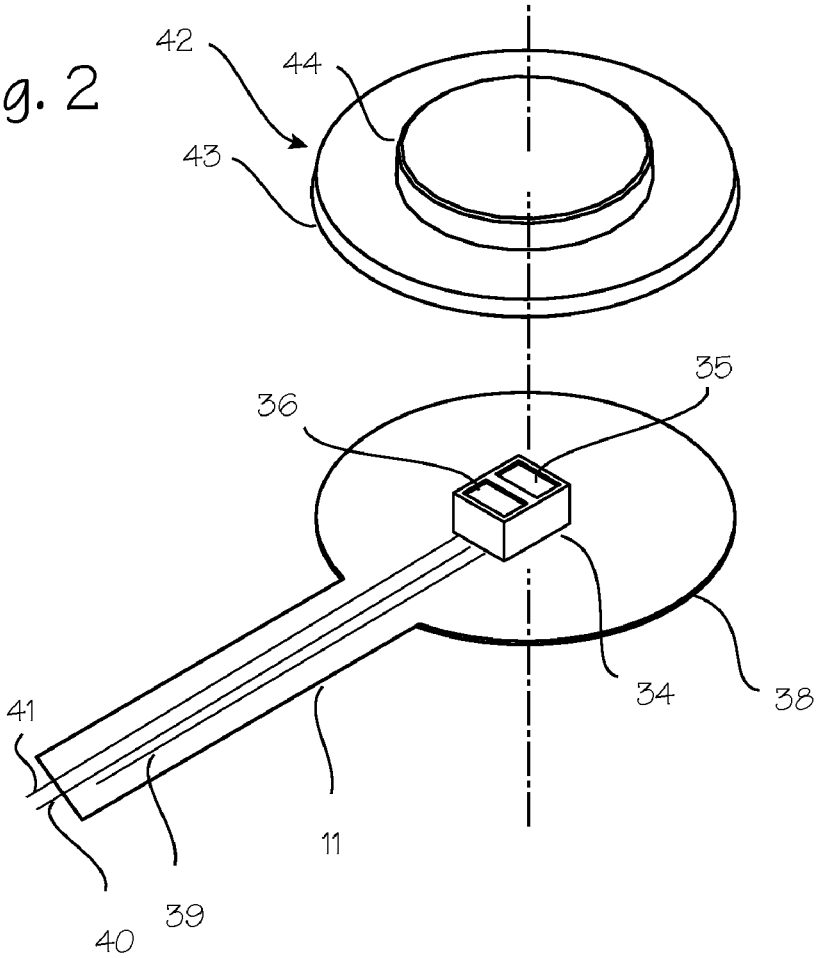
FIG. 2 illustrates the optical sensor and its various components.
Figure 2:
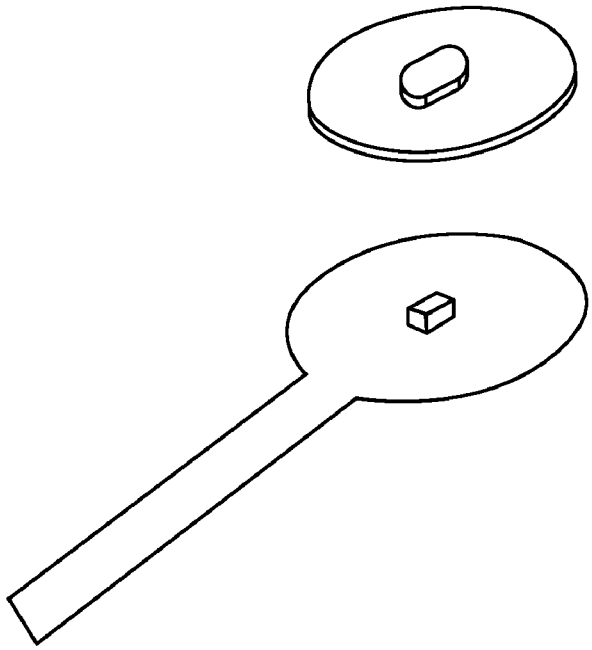

FIG. 2 shows the optical sensor assembly in detail. The optical sensor includes an emitter/detector assembly 34 comprising a light source 35 and a detector 36 arranged on a base 38. The conductor ribbon 11 may be fixed to the assembly or releasably attached with suitable connectors. The conductor ribbon 11 includes a number of generally parallel conductors (including a power conductor 39, a signal conductor 40, and one or more return or ground conductors 41) laminated together for the purpose of supplying electrical power to the light source 35 and for conducting the electrical output signal of the detector 36 to the transceiver and power assembly 10 or 10*p*. In general, the light source 35 is a light emitting diode, laser or other light source and the detector 36 is a photodiode. The central axis of the beam of light emitted by the light source 35 is directed upward so as to strike and reflect from the surface that is being polished. The reflected light falls on the detector 36, which produces an electrical signal in relation to the intensity of the light falling on it. The optical components (and optionally, the end of the conductor ribbon 11) are encapsulated in a thin cap 42 of material that is transparent to the light used for sensing. The cap includes a wide brim 43 for attachment to the base of the emitter/detector assembly and an oval crown 44, with an outer surface sized and dimensioned to fit closely into a corresponding hole in the top layer of the polishing pad, and an interior space sized to accommodate the emitter/detector assembly. The brim acts as a sealing disc and the crown acts as a spacer between the emitter/detector assembly and the pad.

Figure 3:
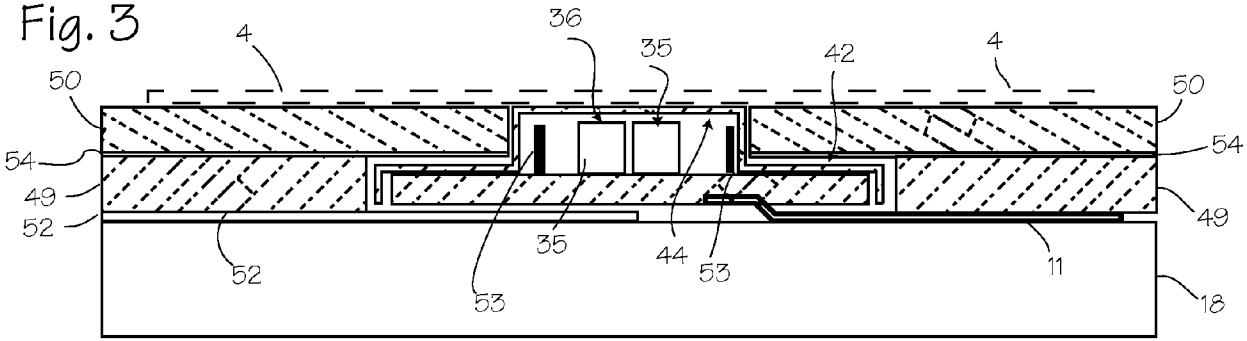
FIGS. 3, 4 and 5 show the pad and optical sensor assembly.
Figure 4:
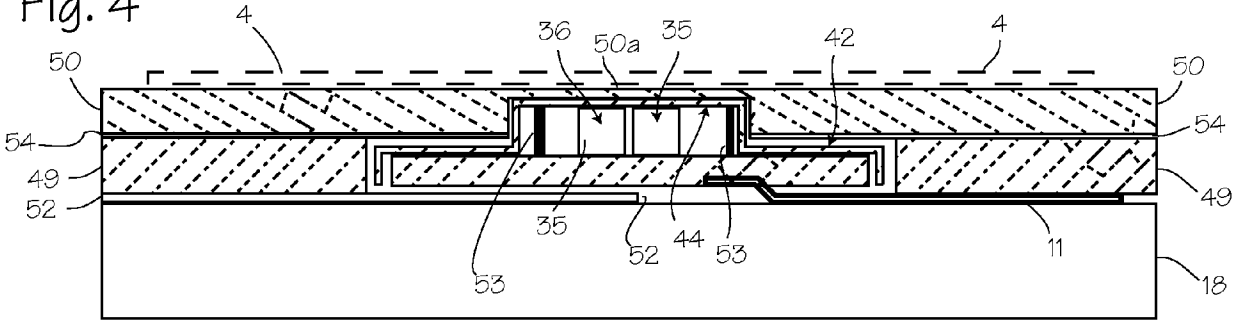
Figure 5:
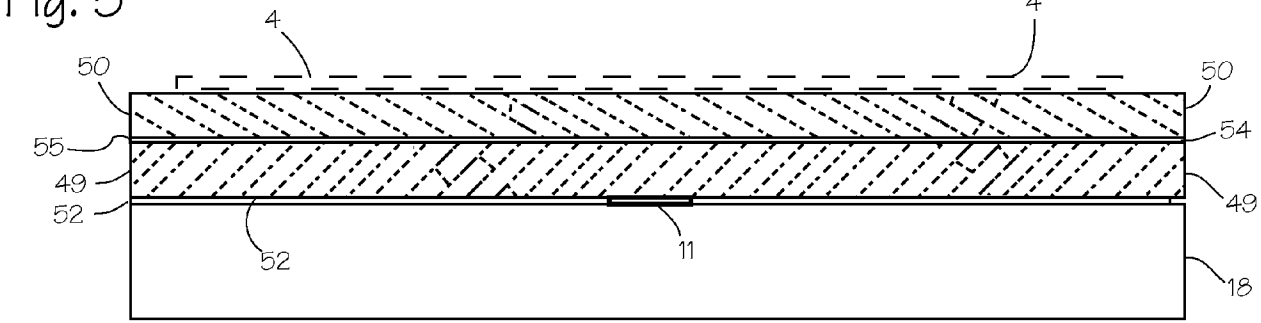

The pad and optical sensor assembly are assembled as shown in FIGS. 3, 4 and 5. As shown in FIG. 3, the polishing pad in which the upper pad optical sensor is embedded comprises a lower pad or sub-pad 49 and an upper pad 50. The hole 51 accommodates the crown of the sensor assembly cap, while the hole in the sub-pad accommodates the flange of the sensor cap assembly. The ribbon cable 11 runs under the sub-pad, in a gap in the adhesive used to secure the pad to the platen, or between the sub-pad and upper pad, in a gap in the adhesive that holds the sub-pad and upper pad. Alternatively, a groove can be machined in the pad through which the ribbon cable is located, especially when the ribbon thickness is greater than the adhesive thickness. FIG. 4 illustrates a modification of FIG. 3, in which the upper pad 50 includes a continuous, integrally formed portion 50*a* which covers the upper surface of the crown 44. This is accomplished by providing a blind hole in the underside of the upper pad which accommodates the crown, and disposing the crown portion of the cap within the blind hole. This construction may be used in applications in which debris build up above or around the crown may be problematic.

As shown in the cross section of FIGS. 3, 4 and 5, the ribbon cable 11 and adhesive layer 52 are substantially the same thickness. This eliminates any deformation of the top pad over the track of the ribbon cable. Although in this illustration the ribbon cable is shown between the platen and the sub-pad, the ribbon cable can also be placed between the sub-pad and top pad, in gap in the adhesive layer. Referring to FIG. 3, the emitter/detector assembly (items 35, 36 and 38 and optional housing 53) is shown within the sensor assembly cap 42. The ribbon cable 11 runs from the sensor assembly to the outer edge of the pad or to the center of the pad, to connect with the transceiver. The cross section of FIG. 5, taken between the sensor assembly and the transceiver and power assembly (whether disposed on the edge of the platen or the center of the pad), further illustrates that the ribbon cable 11 runs through a channel in the adhesive layer 52 which secures the lower pad 49 to the platen 18. The ribbon cable can also be run through a channel in the adhesive layer 54 which secures the upper pad to the lower pad, provided that the ribbon cable is of substantially the same thickness as the adhesive layer. The channel is formed by removing substantially all of the adhesive layer from the intended track of the ribbon cable from a pre-fabricated polishing pad or sub-pad.

The pad and sensor assembly combination may be formed from pre-manufactured pads which are typically provided with a PSA layer and a protective film. The PSA layer is applied to a known thickness, typically 4 mil (0.004"). The assembly is made by forming the cylindrical hole in the sub-pad, and scraping or cutting away the pressure sensitive adhesive on the bottom of the sub-pad along the intended track of the ribbon cable. The typical Mylar protective layer is also removed along the cable track. This creates a groove or channel in which the ribbon cable will sit, which is substantially the same depth as the ribbon cable. Also, the oblong or oval hole is cut through the upper pad. Next, the Mylar film is removed from the top pad, and the top pad is pressed onto the sub-pad, keeping the holes in each pad aligned. Next, the sensor assembly cap (housing spacer and seal disc) is inserted into the pad stack, into the holes so that the oval riser fits snugly into the oval hole of the upper pad, and glued into this recess so that the upper surface of the sensor cap is flush with the upper surface of the pad. Next, the emitter detector assembly is inserted and secured within the riser of the sensor cap, and (if not already attached, one end of the ribbon cable is inserted into the cavity and attached to the emitter/detector assembly. The ribbon cable is glued to the sub-pad, in the track which has been previously cleared of pressure sensitive adhesive. The assembled pad is then applied to the platen, and fixed to the platen. To complete the system, the transceiver is mounted on the edge of the platen or table (preferably, though it can be placed in the center of the table) and attached to the free end of the ribbon cable. Fixed components such as the fixed receiver or transceiver which interconnects the rotating transceiver to the control system with appropriate software, if not already installed, may be installed at any point within or near the CMP tool. The various steps required to produce the pad and sensor combination may be performed in various locations, so that stock pads may be purchased and modified at the point of installation on a CMP platen, or the pad and sensor assembly combination may be assembled by a pad manufacturer and shipped to CMP facilities ready for installation on CMP platens.

When fully assembled in a CMP system for polishing a wafer, the CMP system will include a platen and a polishing pad assembly as described above, a transceiver mounted on the periphery of the platen (or near the center of the pad) which operates to receive data from the sensor assembly and transmit said data to a receiver which in turn is operable to communicate data received from the sensor assembly through the transceiver, to a control system of the polishing tool. The control system is programmed to analyze the data from the sensor assembly to determine and report the state of a wafer being polished in the CMP system, including determining when the polishing endpoint has been reached by the polishing system, and may be further programmed to communicate the attainment of the end-point to an operator, or control the CMP system to cease polishing operations when the endpoint is reached or adjust polishing parameters during polishing depending on the progress of the polishing operation as determined by analysis of the signals achieved from the sensor.

While the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A CMP system for polishing a wafer, said CMP system comprising:

a platen:

a polishing pad assembly comprising:

a polishing pad comprising a polishing layer and a layer of adhesive;

a sensor assembly disposed within the pad, said sensor assembly being operable to detect a condition of a wafer while said wafer is being polished;

a ribbon cable for connecting the optical sensor to a transceiver for communicating data generated by the sensor assembly;

wherein the ribbon cable and the adhesive layer are substantially the same thickness, and the ribbon cable is disposed in a channel running through the adhesive layer;

a first transceiver mounted on the periphery of the platen, said first transceiver operable to receive data from the sensor assembly and transmit said data to a receiver;

a receiver, located on a non rotating portion of the polishing tool, adapted for communication of data from the sensor assembly through the first transceiver, said receiver operably connected to a control system, said control system programmed to analyze the data from the sensor assembly to determine and report the state of a wafer being polished in the CMP system.

2. A method of manufacturing a polishing pad assembly for use in polishing a wafer on a polishing pad which is secured to a platen, said method comprising the steps of:

providing a polishing pad with a layer of adhesive covering a surface of the polishing pad;

providing a sensor assembly having a thickness not exceeding the thickness of the polishing pad;

providing a ribbon cable adapted for connection to the sensor assembly cutting a hole in the polishing pad to accommodate the sensor assembly within the thickness of the pad;

creating a channel in the layer of adhesive;

fixing the ribbon cable to the sensor assembly;

laying the polishing pad on a platen with the layer of adhesive contacting the platen and the ribbon cable disposed within the channel;

securing a transceiver and power supply to the platen, and connecting the ribbon cable to the transceiver and power supply.

3. A method of manufacturing a polishing pad assembly for use in polishing a wafer on a polishing pad which is secured to a platen, said method comprising the steps of:

providing a polishing pad with a layer of adhesive covering a surface of the polishing pad;

providing a sub-pad with a layer of adhesive covering a surface of the sub-pad;

providing a sensor assembly having a thickness not exceeding the thickness of the polishing pad;

providing a ribbon cable adapted for connection to the sensor assembly cutting a hole in the polishing pad to accommodate a first portion of sensor assembly;

cutting a hole in the polishing pad to accommodate a second portion of sensor assembly;

creating a channel in the layer of adhesive covering one of the polishing pad and sub-pad;

placing the sensor assembly into the holes in the polishing pad and sub-pad;

fixing the ribbon cable to the sensor assembly;

laying the sub-pad on a platen with the layer of adhesive contacting the platen, and laying the polishing pad over the sub-pad with the layer of adhesive contacting the sub-pad, with the ribbon cable disposed within the channel;

securing a transceiver and power supply to the platen, and connecting the ribbon cable to the transceiver and power supply.

* * * * *